US009726387B2

(12) United States Patent
Karkhanis et al.

(10) Patent No.: US 9,726,387 B2
(45) Date of Patent: Aug. 8, 2017

(54) HOT GAS REHEAT MODULATION

(71) Applicant: JOHNSON CONTROLS TECHNOLOGY COMPANY, Holland, MI (US)

(72) Inventors: Rajiv Karkhanis, York, PA (US); Curtis Wayne Caskey, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 397 days.

(21) Appl. No.: 14/322,427

(22) Filed: Jul. 2, 2014

(65) Prior Publication Data

US 2015/0013356 A1 Jan. 15, 2015

Related U.S. Application Data

(60) Provisional application No. 61/842,114, filed on Jul. 2, 2013.

(51) Int. Cl.

| | |
|---|---|
| ***F24F 3/00*** | (2006.01) |
| ***F24F 3/153*** | (2006.01) |
| ***F24F 3/14*** | (2006.01) |
| ***F24F 11/00*** | (2006.01) |
| ***F25B 41/04*** | (2006.01) |
| ***F25B 6/02*** | (2006.01) |
| ***F25B 49/02*** | (2006.01) |
| *F25B 5/02* | (2006.01) |

(52) U.S. Cl.

CPC ..... *F24F 3/153* (2013.01); *F24F 3/1405* (2013.01); *F24F 11/008* (2013.01); *F24F 11/0012* (2013.01); *F24F 11/0015* (2013.01); *F25B 6/02* (2013.01); *F25B 41/04* (2013.01); *F25B 49/02* (2013.01); *F25B 5/02* (2013.01); *F25B 2400/0409* (2013.01); *F25B 2400/06* (2013.01); *F25B 2400/075* (2013.01); *F25B 2600/2501* (2013.01); *F25B 2600/2519* (2013.01)

(58) Field of Classification Search

CPC ..... F24F 3/153; F24F 3/1405; F24F 11/0012; F24F 11/0015; F24F 11/008; F25B 6/02; F25B 41/04; F25B 49/02; F25B 5/02

USPC ..... 62/79, 89, 90, 115, 150

See application file for complete search history.

(56) References Cited

U.S. PATENT DOCUMENTS

| | | | | |
|---|---|---|---|---|
| 8,347,643 | B2 * | 1/2013 | Taras | F24F 3/153 62/150 |
| 8,651,391 | B2 * | 2/2014 | Patch | F24F 11/0001 236/49.3 |
| 9,103,575 | B2 * | 8/2015 | Taras | F24F 3/153 |

(Continued)

*Primary Examiner* — Timothy L Maust

(74) *Attorney, Agent, or Firm* — Fletcher Yoder, P.C.

(57) ABSTRACT

A stepped approach to cooling capacity control and the HGRH status logic to achieve the requisite control of humidity and temperature provided to an interior area or building space receiving conditioned air. The system includes at least two independent circuits, each circuit having at least one compressor. At least one of the independent circuits includes hot gas reheat hardware thereby providing HGRH capability. The logic provides an efficient method for maintaining both humidity and temperature in the interior area comfortable for occupants within limits as determined by psychrometrics. The system and method match the sensible capacity and latent capacity of the system match to the sensible and latent loads of the conditioned space.

12 Claims, 5 Drawing Sheets

(56) References Cited

U.S. PATENT DOCUMENTS

| | | | | |
|---|---|---|---|---|
| 2009/0235678 | A1* | 9/2009 | Taras | F24F 3/153 62/115 |
| 2010/0082161 | A1* | 4/2010 | Patch | F24F 11/0001 700/276 |
| 2011/0146306 | A1* | 6/2011 | Taras | F24F 3/153 62/79 |
| 2014/0260368 | A1* | 9/2014 | Wintemute | F25B 6/04 62/89 |

* cited by examiner

HOT GAS REHEAT MODULATION

CROSS REFERENCE TO RELATED APPLICATIONS

This application claims priority to and benefit of U.S. Provisional Patent Application No. 61/842,114 filed on Jul. 2, 2013, and is related to U.S. application Ser. No. 14/322,534 filed on Jul. 2, 2014, each of which are incorporated herein by reference in their entireties.

FIELD OF THE INVENTION

The present invention is directed to hot gas reheat, and more specifically, to hot gas reheat in a building having multiple compressors.

BACKGROUND OF THE INVENTION

Air conditioning systems, such as used in commercial applications, are systems that can be used to cool as well as dehumidify when ambient conditions are such that there is low demand or no demand for cooling. In many cases, and with properly selected equipment matched to the space that is to be conditioned, the sensible capacity and latent capacity of the system match well to the sensible and latent loads of the conditioned space. However, there can be instances where the sensible and latent capacity of the equipment does not match well to the sensible and latent loads. For example, when ambient conditions are such that there is a low demand for sensible cooling but high demand for latent cooling, the sensible capacity of the unit must be decreased, i.e. there is a demand for dehumidification. This demand for dehumidification can often occur on days when the temperature is cool and accompanied by a high humidity level, such as during cooler, damp, rainy days that frequently occur in the spring and autumn seasons and even occasionally during the summer and winter. Under such conditions, operation of the air conditioning system may not be practical solely in the cooling mode. In such conditions, hot gas reheat is utilized to provide control of dehumidification of air delivered into a building interior by a system using the vapor compression cycle. Hot gas reheat has generally been associated with air conditioning systems having one or two compressors in a single circuit, and various operating and control systems have been designed to control both temperature and humidity in such smaller systems. However, as systems become larger, incorporating a plurality of compressors in two or more compression circuits, each compression circuit having one or more compressors, control systems and settings become more complex and the simple controls validated for systems having one or two compressors in a single circuit may no longer be reliable or operational. For such complex systems, different equipment requirements are needed in order to avoid excess costs due to duplicative equipment arrangements, and different logic is required to control the equipment arrangements provided.

SUMMARY OF THE INVENTION

The present invention is directed to an air conditioning system equipped with a hot gas reheat (HGRH) feature for cooling a building or area interior to a temperature within a preselected range while maintaining humidity control of the air delivered to the building interior at a comfortable level for the occupants. The present invention provides the ability to reduce the sensible capacity of the unit to match the sensible load by adding heat from the hot refrigerant gas using hot gas reheat (HGRH). Thus, as supply air lowers the room temperature below a setpoint, heat must be added to the supply air to maintain the room temperature within the setpoint limits. The present invention also increases the latent capacity of the unit by lowering the dewpoint of the supply air as the interior/room humidity increases. Thus, the higher the humidity of the return air, the lower the supply air dewpoint, thereby increasing the latent capacity of the unit. With the combination of the ability to accomplish these two factors, the current invention matches closely the sensible and latent capacity of the unit to the sensible and latent loads in the interior/space. This allows for close control of both the temperature and humidity in the interior/space being conditioned.

The present invention provides a stepped approach to cooling capacity control and the HGRH status logic to achieve the requisite control of humidity and temperature provided to an interior area or building space receiving conditioned air. The system includes at least two independent circuits, each circuit having at least one compressor. At least one of the independent circuits includes hot gas reheat hardware thereby providing HGRH capability for the system.

The at least one compressor in each independent circuit is not restricted by design and may include compressors of fixed or variable speed or capacity, or digital scroll compressors. Thus, any compressor design is contemplated by the present invention, including but not limited centrifugal, scroll, reciprocating and screw compressors.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The present invention provides HGRH status logic for use with an air conditioning system for a building having multiple cooling circuits and optionally utilizing an economizer. The multiple cooling circuit system includes at least two independent circuits, each circuit including at least one compressor. An independent circuit, as used herein, includes at least one compressor, a condenser, an evaporator and dedicated refrigerant circulated within the circuit. Of course, each independent circuit may include other mechanical and electrical equipment well known in the art. One of the at least two independent circuits further includes a hot gas reheat capabilities.

Figure 1:
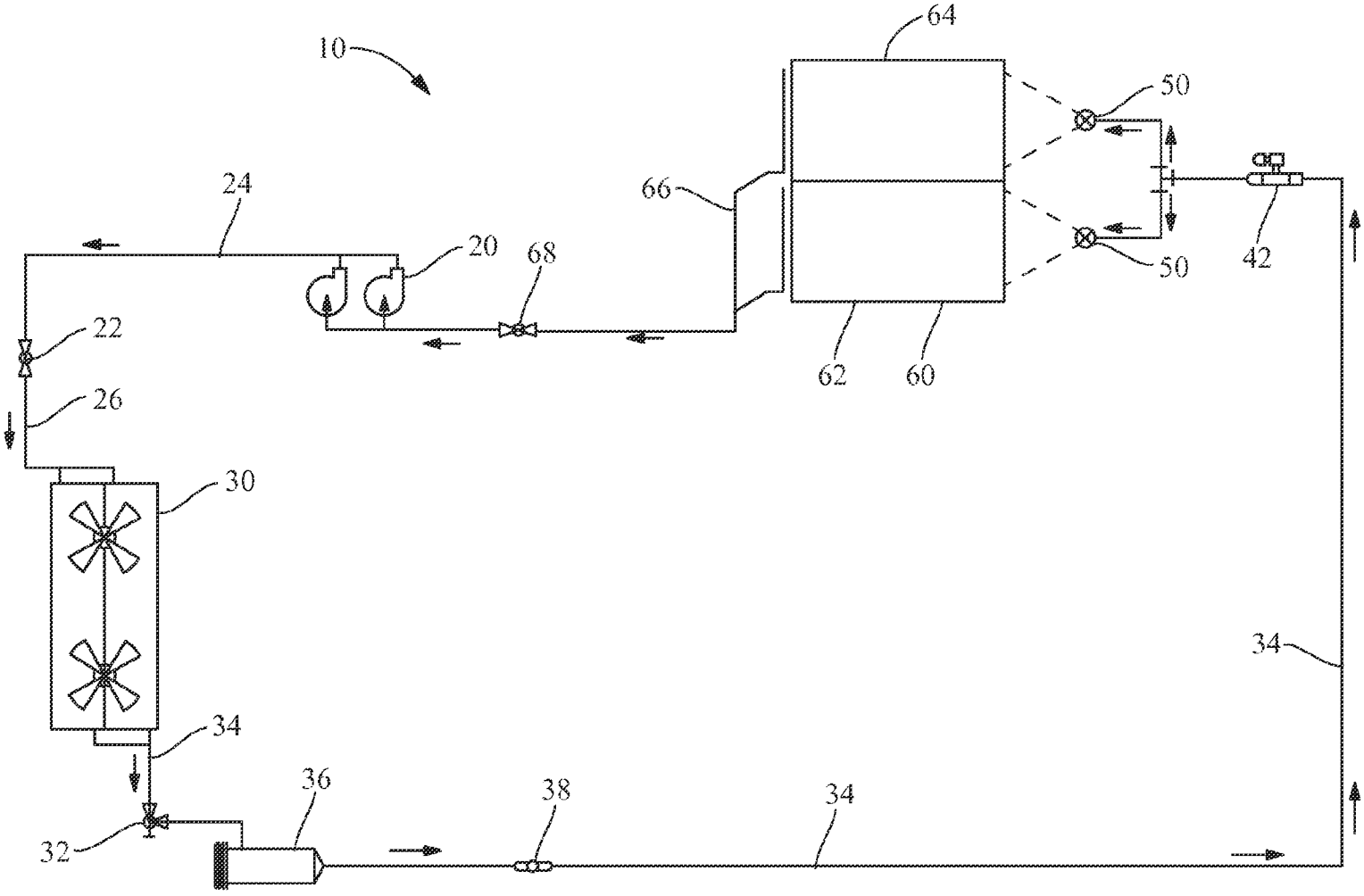
FIG. 1 is a schematic diagram showing a first independent circuit
Figure 2:
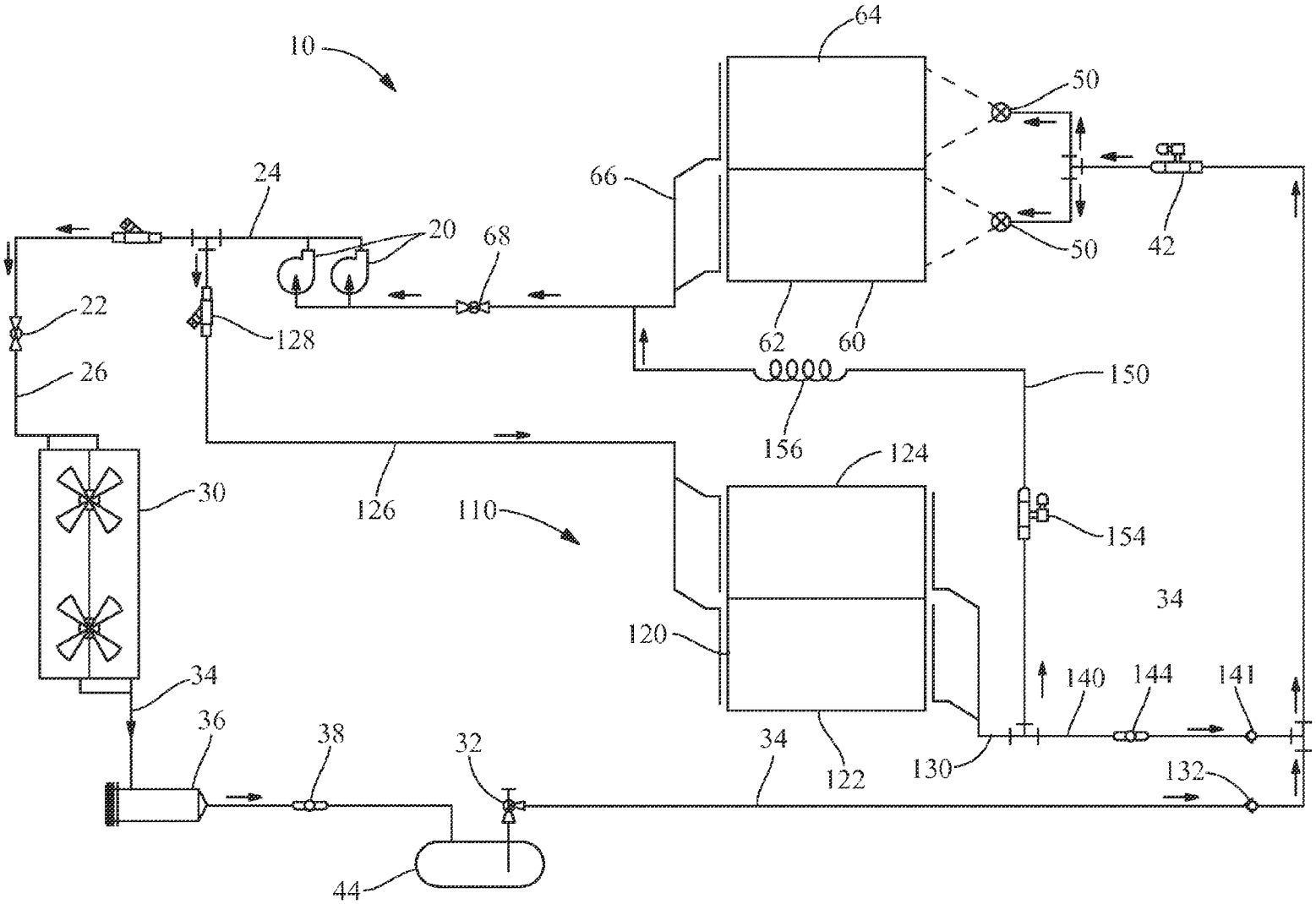
FIG. 2 is a schematic diagram showing a second independent circuit that includes reheat capabilities.

The independent cooling circuits comprising the multiple cooling circuits are depicted in FIGS. 1 and 2. Even though the circuits are independent, the same numbers will be used to designate the same type of equipment in the individual circuits, even though this equipment may be different, e.g. different capacities, in each circuit.

FIG. 1 depicts a standard cooling circuit 10 that comprises at least one of circuits in the multiple cooling circuit system. Refrigerant circulates through circuit 10. The system includes at least one compressor 20. FIG. 1 depicts two tandem compressors and more than two may be utilized. Standard cooling circuit 10 also includes a condenser 30 that receives compressed refrigerant from compressors 20. The compressed refrigerant is provided from compressors 20 to condenser 30 by fluid communication through compressor discharge line 24 to a discharge line shut off valve 22 and through shut off valve line 26. Shut off valve 22 allows condenser 30 to be isolated from the compressor and any type of valve may be used to prevent the back flow of high pressure refrigerant fluid to the compressor. As shown in FIG. 1, condenser is depicted as an outdoor condenser, exchanging heat of condensation with air, but is not so restricted.

The high pressure refrigerant gas in condenser 30 is condensed into a liquid and discharged from condenser 30 which is in fluid communication with thermal expansion valve 50 via liquid line 34. Liquid line 34 may include various equipment such as a liquid line receiver valve 34, a filter drier 36, a sight glass 38 and a liquid line solenoid valve 42. An optional receiver in effect provides a storage vessel for excess refrigerant. While the condensers may utilize any arrangement of coils, the present invention contemplates a preferred arrangement of condenser coils that standardizes the size of the condenser coils in each circuit, and more preferably, standardizes the size of coils among the circuits. This provides advantages for both manufacturability and performance. Solenoid valve 42 enables the liquid line 34 to be isolated from the downstream portion of the circuit, and when used in conjunction with discharge line shut off valve 22 isolates the liquid portion of the circuit that includes the condenser 30 from the remainder of the circuit.

High pressure refrigerant liquid passing through thermal expansion valve 50 is converted to a low pressure mist, which is sent to evaporator 60. As depicted in FIG. 1, evaporator 60 is depicted as two evaporators, bottom evaporator 62 and top evaporator 62, and two thermal expansion valves 50 delivers refrigerant to each evaporator, one valve associated with each evaporator. More than two evaporators 60 and expansion valves 50 may be utilized in a refrigerant circuit. Refrigerant gas from evaporator 60 is returned to compressors 20 via compressor suction line 66. Compressor suction line 66 may include a suction line shut off valve 68, which enables isolation of compressor 20 and/or evaporator 60 when used in conjunction with other previously described valves in the circuit. Return air by forced air circulation passes over evaporator coils, through which refrigerant flows, where the return air is conditioned by cooling and dehumidification before being returned as supply air to the building or area.

FIG. 2 depicts a refrigeration/reheat circuit, the system including at least one such circuit 110. Refrigeration/reheat circuit comprises a standard circuit 10 such as described above as well as a reheat circuit 110. Reheat circuit 110 adds a reheat coil 120. As shown in FIG. 2, there are two reheat coils, a bottom reheat coil 122 and a top reheat coil 124. Additional reheat coils 120 may be included depending on the reheat requirements for the supply air in the building or area being conditioned.

Reheat coil 110 is connected to refrigeration circuit 10 along compressor discharge line. Hot gas reheat (HGRH) valve 128 is positioned along line 126 connected to compressor discharge line 24, to selectively allow hot refrigerant gas to flow from compressors 20 to reheat coil 120 depending on the temperature and humidity of supply air. While this HGRH valve 128 may be a solenoid valve, it may also be a variable flow valve or modulating valve. Equipment provided with the refrigeration/reheat circuit may also include an optional economizer (not shown) which draws outside air into the system when the temperature of the outside air permits natural cooling so that energy used for mechanical cooling is minimized. The economizer air may be added to return air and conditioned as it passes over evaporator 60 before being returned to the building or area to be conditioned. In addition to economizing, outside air may be required by standards as fresh air to replenish the return air. In the present invention, the controller evaluates the outside air temperature, and optionally, relative humidity and determines whether the economizer may be used and to what extent the economizer should be used to contribute to the supply air.

Figure 4:
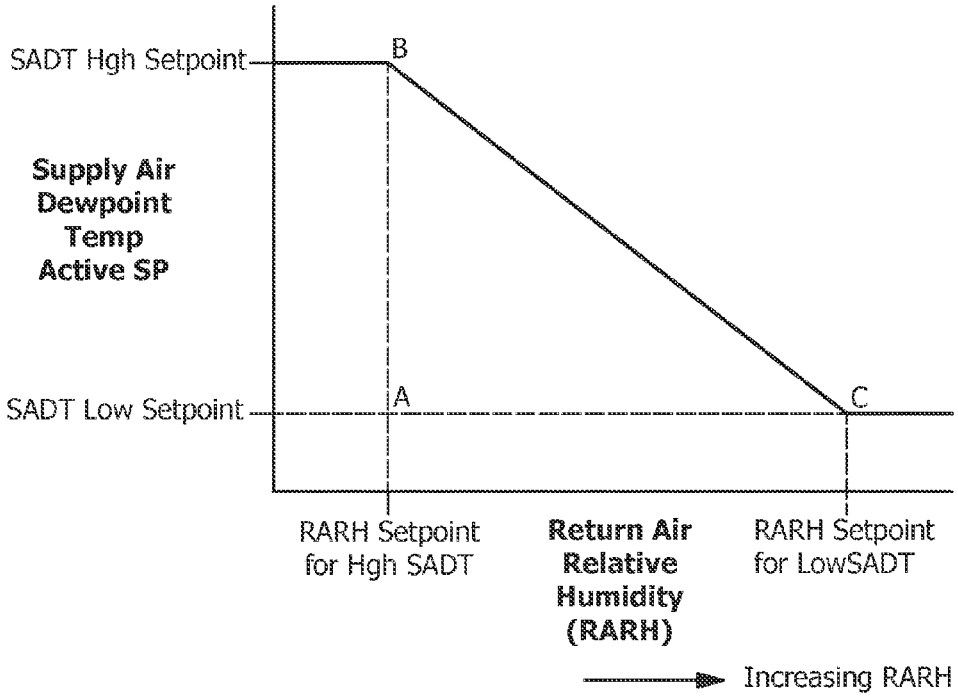
FIG. 4 depicts a graph showing the relationship between supply air dewpoint set points and return air relative humidity.
Figure 5:
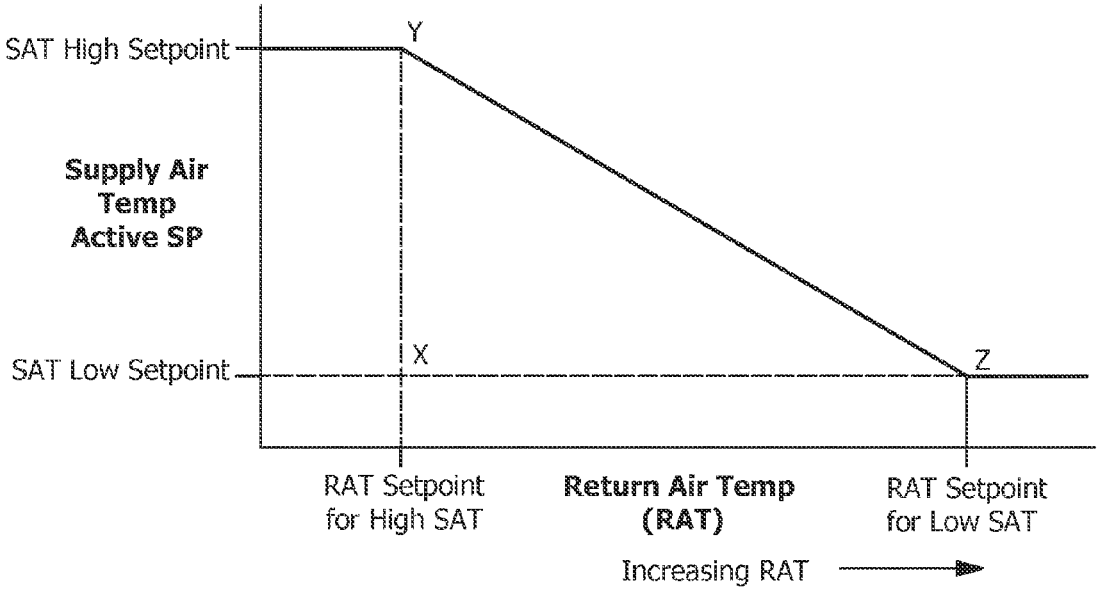
FIG. 5 depicts a graph showing the relationship between supply air temperature setpoints and return air temperature.

In any event, return air is conditioned by passing over evaporator coils in evaporator 60 and provided as supply air. The air leaving the evaporator 60 is cooled to the desired leaving air dewpoint by staging additional compressors on or off until a desired leaving air dewpoint set point temperature is achieved. When the measured Return Air Relative Humidity is high, the desired leaving air dewpoint is low. When the Return Air Humidity is low, the desired leaving air dewpoint is high, that is, the SADT High Setpoint as used in FIG. 4 is high. The lower the Supply Air Dewpoint Temperature (SADT) Setpoint, the greater the dehumidification of the air. The latent capacity of the unit is thus matched to the latent load of the space by turning on the additional compressors, as required, to cool the air leaving the evaporator 60 to the desired SADT Setpoint. Referring now to FIG. 5, as with sensed Return Air Humidity, Return Air Temperature (RAT) is indicative of the temperature in the conditioned space. When the measured Return Air Temperature is high, the desired Supply Air Temperature (SAT Low Setpoint) should be low. When the measured RAT is low, the desired Supply Air Temperature (SAT High Setpoint) is high. After the air is dehumidified, if the air leaving evaporator 60 is colder than the desired Supply Air Temperature (SAT Air Temperature Low SP), the air then passes through reheat coil 120 where hot refrigerant gas is modulated so that the Supply Air Temperature is raised so that falls within a predetermined tolerance range determine by SAT High Setpoint and SAT Low Setpoint. The Sensible Capacity of the unit is thus matched to the Sensible load of the space by modulating the amount of reheat added to the air leaving evaporator 60.

Refrigerant passing through reheat coils is then returned to standard circuit 10. When sufficient heat is drawn from the refrigerant gas, it condenses to a liquid and is returned via reheat circuit liquid line 140 to liquid line 34. Reheat circuit liquid line 140 may include a check valve 141 to prevent the backflow of liquid refrigerant in liquid line 34 into reheat coil 120, while allowing condensed liquid refrigerant from reheat coil 120 to flow into liquid line 34. Reheat circuit liquid line 140 may also include a sight glass 144. HGRH valve 128 modulates the amount of hot gas supplied to reheat coil 120 from compressor discharge line 24, thereby controlling the heat output of the reheat coil 120. The hot gas refrigerant flowing into reheat coil 120 is condensed by cool air after flowing over the evaporator 60. To prevent liquid refrigerant from being unnecessarily trapped in the reheat coils, a HGRH bleed down solenoid valve 154 and capillary tube 156 ensure that when reheat valve 128 is closed, liquid refrigerant does not remain trapped in the reheat coil. When reheat valve 128 is closed, bleed down solenoid valve 154 opens, allowing any remaining liquid in the reheat circuit to drain into compressor suction line 66. Capillary tube 156 limits the amount of refrigerant that can be sucked into suction line 66 through bleed down solenoid valve 154, thereby preventing possible compressor damage. FIG. 2 also depicts a check valve 132 in liquid line 34 to prevent the backflow of liquid refrigerant into optional liquid receiver 44.

While the refrigerant/reheat circuit as depicted in FIG. 2 also is known, the use of a refrigerant/reheat circuit as an independent circuit in conjunction with one or more standard circuits 10 such as depicted in FIG. 1 along with the control logic for controlling the standard circuit(s) and refrigerant/reheat circuit provides a unique control scheme for operation of the independent circuits of the system while permitting more effective and energy efficient control of conditioned supply air provided to a building or air space.

Figure 6:
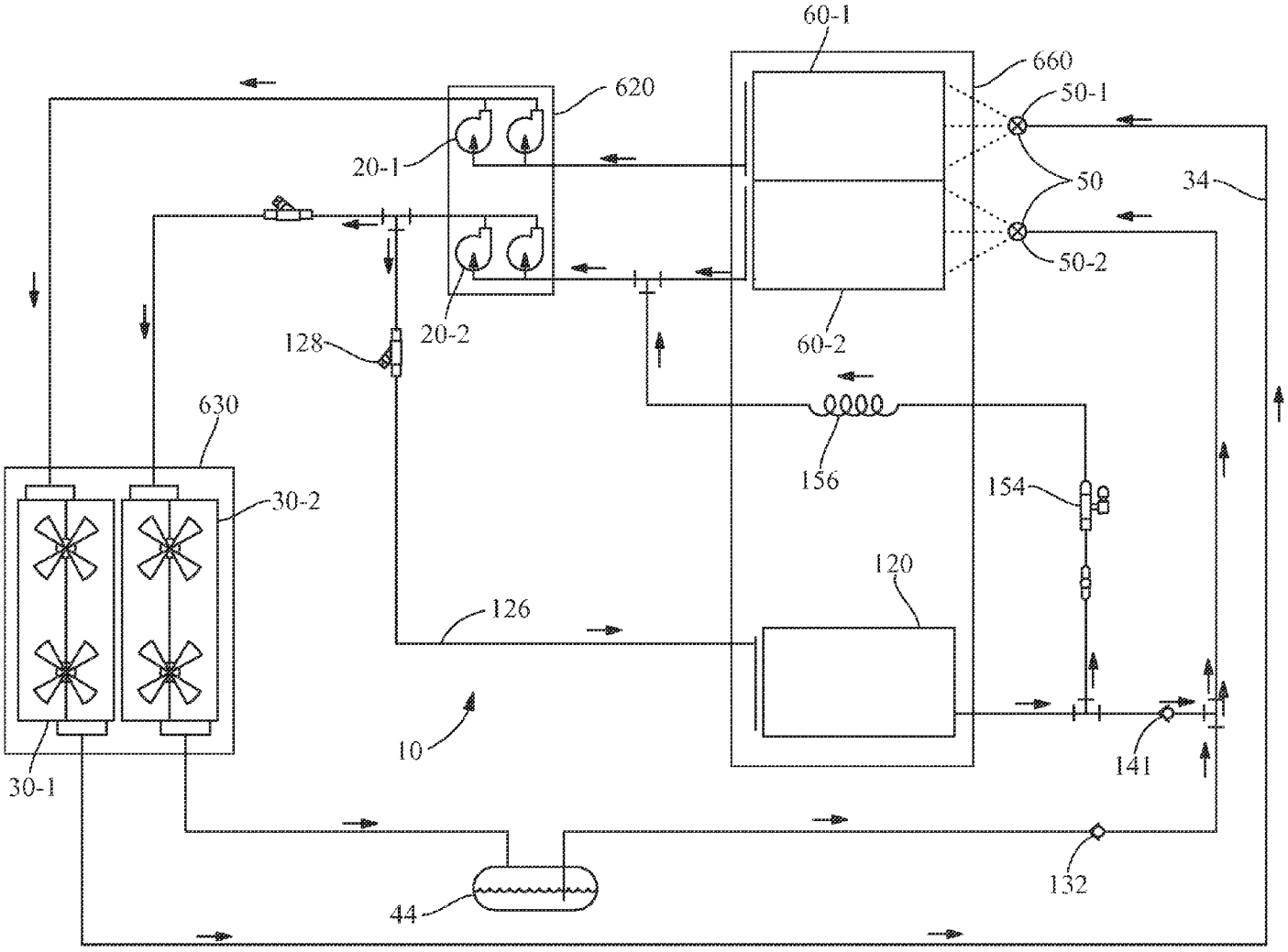
FIG. 6 is a schematic of FIG. 1 and FIG. 2, depicting two independent circuits assembled as a single system.

FIG. 1 shows an independent refrigeration circuit while FIG. 2 shows an independent refrigeration/reheat circuit, that is, a refrigeration circuit that includes HGRH capabilities. While the circuits are independent and are shown separately in FIGS. 1 and 2, a plurality of independent circuits and be assembled together as a system to more efficiently utilize available space. For example, the circuits of FIGS. 1 and 2 are shown assembled together as a system in FIG. 6. While FIG. 6 shows two circuits, a system of more than two circuits may be assembled together. Referring now to FIG. 6, compressors are assembled in a single cabinet 620, which contains the compressor tandem 20-1 from system 1 and compressor tandem 20-2 from system 2. Likewise, condensers from the plurality of systems are assembled together in a single cabinet 630, which contains the condensers 30-1 and 30-2 from system 1 and system 2 respectively. Evaporators from the plurality of systems are assembled together in a single cabinet 660 or ductwork, which contains the evaporators 60-1 and 60-2 from system 1 and system 2 respectively. The cabinet 660 also includes reheat coil 120, so that the flow of cooled air from the evaporators flows over or through reheat coil 120, which can be used to heat the cooled air from the evaporators when needed. As is apparent to one skilled in the art, a plurality of independent circuits, more than the two disclosed in FIG. 6, can be packaged together as described above as a single system.

The supply air system of the system as described above may include the ability to admit outside air into the building, using equipment such as the economizer, which also may be used to satisfy any ventilation requirements. Equipment such as the economizer is optional. An air economizer permits the addition of fresh outside air into the area of building requiring conditioning such as cooling when outside air is cooler than the return air, reducing the need for mechanical cooling. The system includes not only the independent circuits whose operation is described above, but also a number of sensors that monitor the outside temperature, and preferably humidity, as well as the supply air parameters to determine operation of the independent circuits to assure that supply air parameters are within settings applied to the building or area being conditioned. The system includes a controller that receives signals indicative of conditions such as air dewpoint and temperature, and compares the actual conditions to set points selected to maintain comfortable temperatures and humidity within the building or area to be cooled. Setpoint values may be programmed into the controller or may be communicated to the controller from a remote device. The controller then dictates operation of one or more independent circuits, including the independent circuit(s) that includes the reheat circuit, to condition supply air and/or add economizer air (when an economizer is available) to maintain the building or area within settings that are comfortable for occupants, for both temperature and humidity.

Supply air and return air are monitored by sensors that measure humidity and temperature. The controls, and the logic that operates the controls, include adjustable set points for supply air dewpoint temperature and supply air temperature. The high and low values of these setpoints are preselected and establish a range, and the values may be adjusted. The relative humidity of the return air is monitored, and this measured relative humidity is used to reset the Supply Air Dewpoint setpoint. Referring to FIG. 4, when the Return Air Relative Humidity (RARH) is high, the Supply Air Dewpoint Temperature Set Point is adjusted to a low value (SADT Low SP). When the Return Air Relative Humidity (RARH) is low, the Supply Air Dewpoint Temperature Set Point is adjusted to a high value (SADT High SP). The supply air, which may include outside air that may be added to the supply air, can be provided to the building at the proper temperature and humidity to maintain a comfortable environment for the occupants of the building.

The control logic of the present invention controls both the cooling and dehumidification provided by the multiple cooling independent circuits in the system. The logic, by monitoring the conditions of the return air, supply air and optionally the outside air, determines the operation of the independent circuits as well as the operation of the optional economizer to maintain the supply air provided to the building within a comfortable zone for occupants, such as may be determined by psychrometrics.

Figure 3:
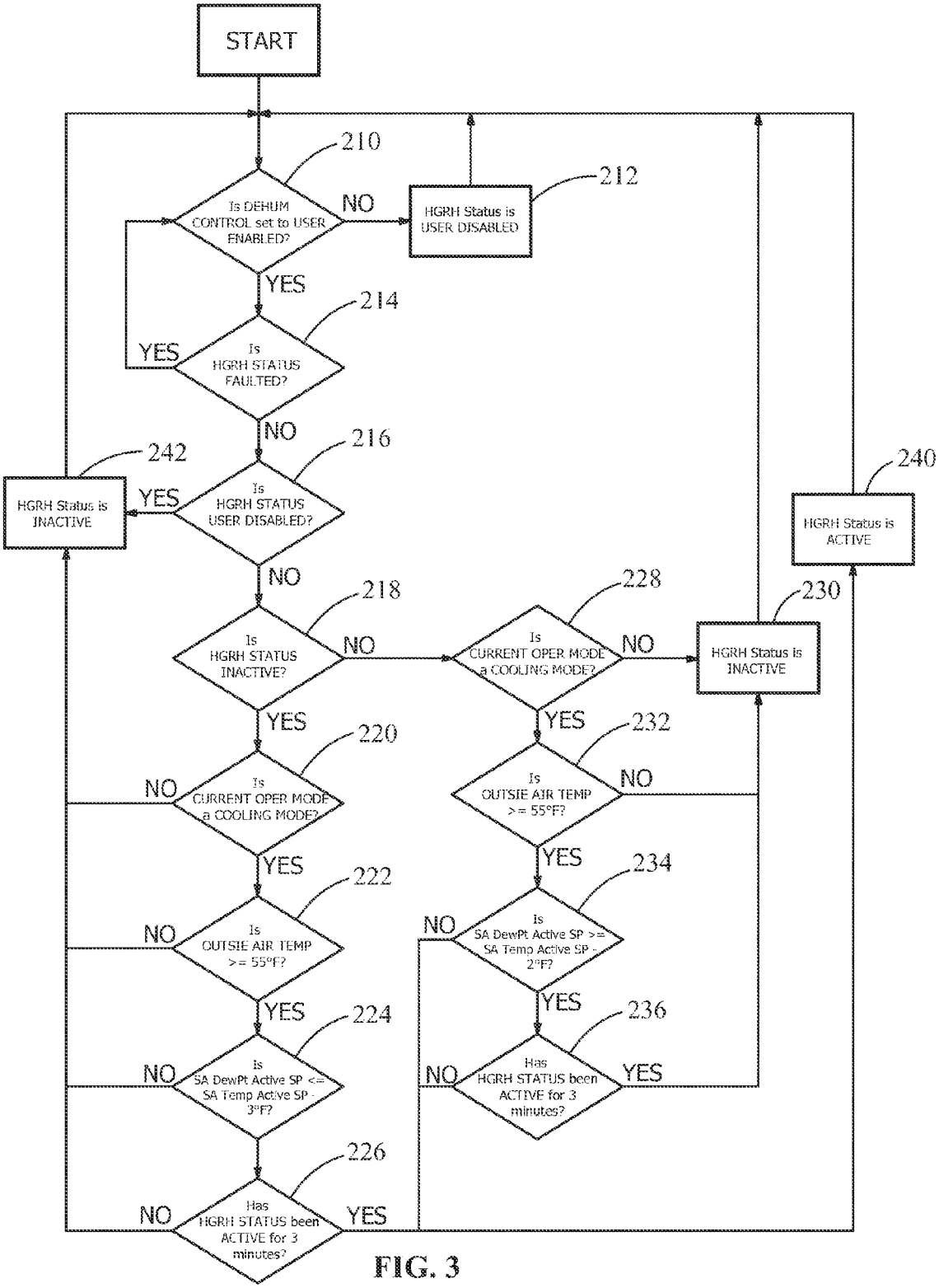
FIG. 3 is a flow chart illustrating the hot gas reheat status logic of the present invention.

Referring now to FIG. 3, the controller in conjunction with the sensors, monitor system operation including the hot gas reheat status logic of the circuit. The system monitors in step 210 whether the user, such as a maintenance superintendant, has enabled dehumidification control, step 210, that is, a setting for HGRH being "on". If dehumidification control has not been enabled, no further action is taken by the controller, step 212, nor will it be taken until dehumidification control is enabled by changing the setting to "on". Once dehumidification control is enabled, the controller then monitors whether HGRH status is faulted, step 214. Controller operation includes the control logic that receives signals indicative of temperatures, pressures, dew points etc., and determines whether the monitored values are within preset limits or setpoints, that is, within the settings on the controller. If the monitored values are present, then the systems are allowed to operate. If the monitored values are not present, the controller determines faults and returns to step 210. If HGRH is faulted, no further action is taken until the HGRH fault is corrected or removed. Once it is determined that HGRH status is not faulted, the program once again determines whether HGRH status is user enabled/disabled, step 216. If user status is disabled, the program restarts, that is, it returns to monitoring status in step 210.

Once the HGRH is determined to be enabled, step 216, the program checks the operational mode to determine if the HGRH status of the system is active or inactive in step 218.

If the HGRH status is inactive but the system is operational, the program determines whether the current operating mode is a cooling mode, step 220. With regard to at least one independent cooling circuit 10, this determination is that at least one cooling circuit is operational. If the current operating mode is not in a cooling mode, the program is terminated by the controller which returns to monitoring status. However, if the controller determines that current operating mode is a cooling mode in step 220, the controller checks outside current temperature sensor readings to determine whether outside ambient air temperature is greater than or equal to a predetermined value, 55° F. (12.7° C.), or less than 55° F. (12.7° C.), step 222 FIG. 3. It will be understood that the predetermined value specified in FIG. 3, step 222 is not limited to 55° F. and may be any other predetermined value. This step is skipped or may not be present if no economizer is installed. The remaining steps assume economizer operation, and one skilled in the art will recognize that when no economizer is present or operational, some of the described steps are skipped.

In step 222, if the outside air temperature is less than the predetermined value, specified as 55° F. (12.7° C.), the controller sets HGRH STATUS to INACTIVE and thus stops reheat. There is an assumption implicit in the logic shown in the FIG. 3 flow chart, and hence the controller logic that when measured outside air temperature is 55° F. (12.7° C.) or less, there is little need for dehumidification. However, mechanical cooling or the economizer may still be used.

If the outside air temperature is greater than or equal to the predetermined value, the predetermined value being 55° F. (12.7° C.) in FIG. 3, step 222, the controller then monitors the supply air (SA) dew point active set point and the supply air temperature active set point, FIG. 3, step 224. When the supply air dew point active set point is determined to be less than or equal to the measured supply air temperature active set point by at by a predetermined amount, the difference between an active parameter set point and a measured parameter being represented by Δ, here the predetermined ΔT represented by three degrees (3° F.), then no HGRH is required and the program returns to start or monitoring status. However, when this ΔT is determined to be greater the predetermined amount, three degrees (3° F.) in this example, the program next determines HGRH status. The ΔT may be any temperature differential and the selected value is provided as a typical example.

The HGRH status determination in step 226 entails the controller determining whether HGRH mode is active or inactive, and if inactive whether it has been inactive for a at least a minimum predetermined time. In FIG. 3, step 226, this minimum predetermined time is at least three minutes. However, the minimum predetermined time is not so restricted and may be any preselected time, and may even be a variable time based on measured values such as outside temperatures or dew points that can be used to calculate the amount of time to restore temperatures or humidity values to within set points based on these measured values. The controller next determines whether HGRH mode is active or inactive. If the controller determines that HGRH mode has been inactive for less than the minimum preselected time, three minutes in the example provided, HGRH remains inactive, step 242 and the program returns to start or monitoring status until the predetermined time, here three minutes, has elapsed. When the controller determines that HGRH has been inactive for longer than the minimum preselected time, HGRH status is activated, step 240. If the controller determines that HGRH status is already active, also step 240, then the HGRH continues to run and the program returns to monitoring status to monitor for a change in conditions. The preselected period of time avoids "hunting," which can result in constant cycling of the HGRH mode when dehumidification values are near the set points. While the preselected time period or the predetermined ΔT may possibly result in temporarily high humidity, it also avoids constant cycling of compressors which is both energy inefficient and can shorten compressor life.

Returning to step 218, the controller determines whether HGRH status is active or inactive. If HGRH is active the controller next determines, in step 228, whether the current operating mode in HGRH also includes a cooling mode, as HGRH may occur without a call for cooling. If the controller determines that the current operating mode does not require cooling, HGRH is inactivated at step 230, cooling also being inactivated if it has not already been inactivated, and the system returns to monitoring status. Preferably, the controller also determines whether the compressors providing cooling and reheat have been running for a minimum predetermined time. If the controller determines that the compressors have not been operating for this minimum run time, their operation is continued until the minimum run time is satisfied. Preferably, this minimum run time is at least three (3) minutes.

In step 228, the system being in HGRH, when the controller determines that the system also is in a cooling mode, the controller evaluates the temperature measurement from an outside temperature sensor, step 232. When the outside air temperature is less than a predetermined temperature, 55° F. (12.7° C.) in the example, then HGRH is inactivated and the controller returns to monitoring status. However, when the outside temperature sensors signal the controller that the outside temperature is greater than or equal to the predetermined temperature, 55° F. (12.7° C.) in this example, continued operation of HGRH may be necessary and the controller proceeds to step 234.

In step 234, the controller determines whether HGRH should be activated or inactivated by comparing the supply air dew point active set point and the supply air temperature active set point. If the controller determines that the ΔT between the supply air temperature active set point and the supply air dew point active set point is less than or equal to a predetermined amount, 2° F. in the example, then HGRH is still required and the controller maintains the system in HGRH, while the controller returns to a monitoring mode. If the controller determines that the supply air dew point is greater than the supply air temperature active set point by more than ΔT, ΔT being two degrees (2° F.) in this example, the system then determines in step 236 how long the HGRH mode has been active. If the HGRH mode has been active for at least a preselected period of time, three minutes in the example, then the HGRH mode is inactivated, step 230, and the control returns to monitoring status. However, if the HGRH mode has not been active for at least the preselected period of time, three minutes in the example, the system remains in the HGRH mode, with the controller monitoring status. Once the preselected period of time is satisfied, HGRH mode is terminated. The preselected period of time as well as the predetermined ΔT assures minimum system operation of the HGRH mode to avoid "hunting," which can result in constant cycling of the HGRH mode when dehumidification values are near the set points. While the preselected time period or the predetermined ΔT may possibly result in some over-dehumidification, it also avoids constant cycling of compressors which is both energy inefficient and can shorten compressor life.

When the dehumidification reheat mode is enabled by the user, the controller constantly monitors temperatures and humidity and activates the independent circuit having the dehumidification capabilities only when monitored conditions indicate that dehumidification without cooling is required before supply air is returned to the building or space, so that dehumidification does not occur when it is not needed. Furthermore, once HGRH mode is activated, the control logic monitors the system operation so that the HGRH mode does not run when it is no longer required. The control logic monitors operation so that the independent circuit having the reheat circuit does not "hunt", that is, it does not short cycle when actual supply air humidity is near the set points, either high or low. Thus, the controls and the logic maintain the building not only within comfortable temperature levels, but also within comfortable humidity levels so that the hot gas reheat circuit is operated when required with the air conditioning system to maintain temperature within a preselected temperature comfort zone without causing discomfort due to low or high humidity, while also providing efficient operation of the cooling circuits.

Air conditioning, in addition to cooling, condenses moisture from the air passing through evaporator 60, while reheat raises the temperature of the cooled air without adding moisture to provide supply air with proper humidity and temperature. Without hot gas reheat, compressors run to satisfy only a cooling call for a shorter period of time so that not as much moisture is removed from the air by condensation. With hot, humid supply air (step 224), limited reheat is required raise the temperature of the air after moisture condensation. With hot, dry supply air (step 236), there is limited reheat required. Cool dry supply air (step 224) does not require reheat. Warm moist supply air (step 234 and step 236) utilizes active reheat (but may limit active reheat when the dew point temperature active set point approximates the supply air set point temperature).

FIG. 4 and FIG. 5 provide graphs showing how the system of the present invention, using the controller and the above described logic, efficiently utilize cooling and reheat to maintain the area or building at or close to comfort levels within the preselected setpoints with regard to humidity and temperature. FIGS. 4 and 5 may be used in conjunction with one another.

Referring again to FIG. 4, there is depicted a graph showing the relationship between desired supply air dewpoint temperature setpoints versus return air relative humidity. This graph show the advantages of the logic set forth above used to control the independent circuits of the present invention. The abscissa represents the measured return air relative humidity while the ordinate represents the desired supply air dewpoint temperature set point. Along the abscissa, there are preselected values representing return air relative humidity (RARH) setpoints for supply air dewpoint temperature (SADT) (i.e. adjustable limits), a RARH setpoint for high SADT and, to the right, a RARH setpoint for low SADT, RARH increasing in the direction of the arrow. Along the ordinate, there are preselected values representing SADT set points, a SADT low setpoint and further up, a SADT high setpoint.

Referring again to FIG. 5, there is depicted a graph showing the relationship between supply air temperature set point and return air temperature. This graph show the advantages of the logic set forth above used to control the independent circuits of the present invention to deliver air having the proper temperature within preselected setpoints. The abscissa represents the return air temperature while the ordinate represents the supply air temperature set point. Return air temperature is a measured value/input. Along the abscissa, there are preselected values representing return air temperature (RAT) setpoints for return air temperature (RAT) (i.e. adjustable limits), a RAT setpoint for high SAT and, to the right, a RAT setpoint for low SAT, RAT increasing in the direction of the arrow. Along the ordinate, there are preselected values representing SAT set points, a SAT low setpoint and further up, a SAT high setpoint establishing a range.

FIG. 4 represents the desired dewpoint of the supply air. This determines how cold the supply air should be and thus the number of compressors in a multi-compressor system from the independent cooling circuits that must be activated. FIG. 5 represents the desired supply air temperature and determines, along with FIG. 4, how much the supply air needs to be reheated.

Referring again to FIG. 4, a vertical line parallel to the ordinate at the RARH setpoint for High SADT intersects the SADT High Setpoint at a point B. The dashed line AB represents a boundary for the relative humidity of air, with the area to the left of this line being an acceptable low relative humidity and the area to the right representing air that may require dehumidification. A vertical line parallel to the ordinate at the RARH setpoint for Low SADT intersects the SADT Low Setpoint at point C. The solid line BC represents the proper combination of temperature and humidity, and the controller using the logic set forth above to reheat the air and drive the temperature and relative humidity to a point along line BC, i.e. points on and between line BC and AC fall within the SADT setpoints and the RARH setpoints, while points above and to the right of line BC are outside of the setpoints. If a measured relative humidity falls within this range, dehumidification is required.

The ordinate determines how cold the air leaving evaporator 60 must be (supply air dewpoint) which indirectly determines the number of compressors and hence the cooling stage(s) in the system that must be activated. The controller may make this determination based on, for example, how far actual conditions deviate from set points. The cooling stage number is further described in U.S. application Ser. No. 14/322,534 filed on Jul. 2, 2014, incorporated herein by reference in its entirely. Thus, more stages that are required for cooling, i.e. the colder the supply air should be, as measured return air humidity increases. The vertical distance of any point on line BC from the abscissa (as determined by a vertical line parallel to the ordinate) is an indication of how cold the air leaving evaporator 60 must be, and the smaller the distance, the colder the air must be.

When the dehumidification control on the controller is set so that hot gas reheat is operational, FIG. 4 provides a visual representation of how the controller logic operates using reheat to provide the area or building with supply air at the proper temperature and proper relative humidity. If the measured return air relative humidity is high, but the temperature is low, the air is cooled by compressor activation to remove moisture. The lower temperature may bring the measured relative humidity of the cooled air between the setpoints, and raising the temperature of the dehumidified air to within the temperature setpoints, toward line BC, results in the relative humidity of the air being lowered even more.

Referring now to FIG. 5, a vertical line parallel to the ordinate at the RAT setpoint for High SAT intersects the SAT High Setpoint at a point Y. A vertical line parallel to the ordinate at the RAT setpoint for Low SAT intersects the SAT Low Setpoint at a point Z. Dashed line XY represents the low temperature boundary for return air, with the area to the left of this line being below the desired high temperature supply air temperature setpoint and the area to the left representing an acceptable return air temperature. The solid line YZ represents a temperature within the comfort zone. Any points above and to the right of line YZ are outside of the supply air temperature setpoints and require cooling, the controller using the logic set forth above using the independent circuits to cool the air and drive the temperature to a point along line YZ. The distance of the vertical line from line YZ to the abscissa is inversely proportional to the amount of cooling required to cool return air to an acceptable supply air temperature.

When the RAT is below the SAT high setpoint, little or no sensible cooling is required. As the measured RAT moves above the SAT high setpoint, sensible cooling is required to adjust the temperature back within the SAT High Setpoint and the SAT Low Setpoint range. When reheat is active, referring to FIG. 4, the measured return air relative humidity may be too high for the return air, so the controller logic continues cooling operation until the relative humidity falls within the Supply Air Dew point temperatures, preferably toward a point on line BC of FIG. 4. The temperature corresponding to this dew point temperature may be low, requiring operation of the reheat coil to raise the temperature toward a point on line YZ in FIG. 5. This increase in temperature further lowers the relative humidity and moves it to the left of line BC of FIG. 4, which is acceptable. As the RAT increases, less heat is required until equilibrium is reached. Equilibrium is defined as when the latent capacity (moisture removal) and sensible capacity (ΔT) match the latent and sensible loads of the conditioned interior/space. As the cooling demand increases and more humidity is removed by the increased cooling, the need for overcooling to remove humidity from the air and reheat to restore the temperature decreases and depending on conditions, no reheat may be required.

As an example, if the measured return air relative humidity is lower than the RARH Setpoint for High SADT (FIG. 4) and the measured RAT is higher than the RAT Setpoint for SAT High Setpoint (FIG. 5), then the controller will not operate the hot gas reheat (assuming dehumidification is enabled) and the lower of the SADT Active Setpoint and the SAT Active Setpoint will determine the number of independent cooling circuits that must be operated and the number of compressors in each of the independent cooling circuits that must be operated to cool the return air. In other words, the controller will stage cooling and compressor operation based on the lower of SADT Active Setpoint or SAT Active Setpoint. That is, cooling and dehumidification will occur until conditions are satisfied by operation of the independent cooling circuits without the need for reheat, dehumidification automatically occurring as a result of cooling.

In a second example, if the measured RARH is higher that the RARH Setpoint for High SADT, FIG. 4, and the measured RAT is lower than the RAT setpoint for High SAT, FIG. 5, and the outdoor air temperature is higher than 55° F., then the controller will stage compressor operation using the lower of the SADT Active SP and the SAT Active SP and will use hot gas reheat (HGRH) to maintain SAT Active temperature between its setpoints, that is within the SAT Active temperature range, the SAT Low and SAT High Setpoints establishing the range. The HGRH circuit will be activated if not already activated. That is, the return air having a high relative humidity will be cooled to lower the humidity, outside air above 55° F. will be added (assuming an economizer is available) and the cooled air having lower humidity will be heated to an active SAT temperature within the setpoint range using the independent circuit that includes the reheat circuit.

In a third example, if the measured RARH is higher that the RARH Setpoint for SADT High, FIG. 4, and the RAT is lower than the RAT Setpoint for Low SAT, FIG. 5, and the outdoor temperature is above 55° F. (assuming an economizer is available), then the controller dictates that the lower of the SADT Active SP and SAT Active SP be used to stage the number of compressors or independent circuits. HGRH is staged as needed by the independent circuit that includes the reheat circuit as needed to maintain the SAT Active SP between its high and low setpoint (i.e. range). Thus, if cooling to lower the measured RARH (and the addition of outside air) also lowers the temperature of the air below the supply air temperature (SAT) Low setpoint, reheat is used to raise the supply air temperature as needed to maintain it within the SAT Active Setpoint range.

In a fourth example, if the measured RARH is at or below the RARH Setpoint for High SADT, FIG. 4, then the controller uses Active SAT SP as the basis for staging the compressors as needed. The measured RARH is low, being at or below the RARH. Cooling to lower the relative humidity is not required and any further cooling is necessitated solely due to the measured temperature being outside the supply air temperature range and cooling lowers the temperature to within this temperature range; no reheat is required.

The relative humidity of return air and supply air temperature active set point range determine whether the controller activates the independent circuits of the present invention to provide cooling and hot gas reheat.

$$\text{Sensible capacity}/(\text{sensible capacity}+\text{latent capacity})=\text{SHR}$$

where SHR is the sensible heat ratio.

The sensible capacity is the capacity of a substance, air in this case, to be heated or cooled and the temperature of the air increases or decreases as a result of this heating or cooling, while latent capacity is the heat that can be added to or removed from a substance with no change of temperature. In cooling mode, as discussed above latent capacity results from the removal or condensation of water vapor from the return air by cooling the air as the water vapor condenses on evaporator coils, as well as by the change in temperature. Sensible heating on reheat raises the temperature of the air when it falls outside of the supply air temperature range determined by the high/low setpoints.

The cooling load is controlled by cooling the return air relative humidity (RARH) to match the supply air dew point (SADP). This cooling provides both sensible cooling and latent cooling. Reheating is provided to reheat the cooled air so as not to provide overcooled air while sensibly reheating the air by modulating reheat. The reheating by the HGRH circuit heats the air to within the SAT range, so it provides sensible heating. Supply air dew point (SADP) is set to a predetermined range to provide air at an appropriate supply temperature by providing any required reheat so that the supplied air is not overcooled. The reheat required will match sensible heat capacity after sensible and latent cooling to remove moisture.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An air conditioning system, comprising:

a multi-circuit system having a plurality of independent cooling circuits, each of the independent cooling circuits having at least one compressor;

a hot gas reheat circuit integral with a first independent cooling circuit of the plurality of independent cooling circuits;

a controller including a logic program that matches the latent heat capacity of the system to the latent load of an interior space being conditioned and also matches the sensible heat capacity of the system to the sensible load of the interior space being conditioned by activation of a second independent cooling circuit of the plurality of independent cooling circuits and selective activation of the first independent cooling circuit including the hot gas reheat circuit;

a return air temperature sensor in communication with the controller monitoring return air temperature;

a return air humidity sensor in communication with the controller monitoring return air humidity;

a supply air temperature sensor in communication with the controller monitoring supply air temperature;

a supply air dewpoint setpoint; and a supply air temperature setpoint;

wherein the controller adjusts a supply air dewpoint setpoint in response to a signal from the return air humidity sensor;

wherein the controller adjusts a supply air temperature setpoint in response to a signal indicative of a temperature from at least one of the return air temperature sensor and the supply air temperature sensor; and wherein the controller modulates operation of one of the plurality of independent cooling circuits and modulates operation of the hot gas reheat circuit integral with one of the plurality of independent cooling circuits in response to the supply air dewpoint setpoint and the supply air temperature setpoint.

2. The system of claim 1 wherein the logic program of the controller determines a number of independent cooling circuits to activate of the plurality of independent cooling circuits and the number of compressors in each of the activated independent cooling circuits to activate in response to at least one of the signal from the return air temperature sensor indicative of return air temperature, the signal from the return air humidity sensor indicative of return air humidity, the supply air dewpoint setpoint and the supply air temperature setpoint.

3. The system of claim 1 wherein the hot gas reheat circuit integral with the first independent cooling circuit of the plurality of independent cooling circuits further includes:

a reheat coil, the reheat coil being downstream of at least one evaporator of a plurality of evaporators in the multi-circuit system;

a first line placing the reheat coil in communication with a compressor discharge line of the first independent cooling circuit integral with the hot gas reheat circuit, the first line providing hot compressed refrigerant gas to the reheat coil; and a second line placing the reheat coil in communication with a liquid line, the liquid line supplying liquid refrigerant to an evaporator of the first independent cooling circuit integral with the hot gas reheat circuit, the second line providing condensed refrigerant from the reheat coil to the liquid line.

4. The system of claim 3 wherein the hot gas reheat circuit further includes:

a valve in the first line selectively isolating the reheat coil from the compressor discharge line; and a check valve in the second line, the check valve positioned preventing the back flow of liquid refrigerant into the reheat coil from the liquid line to the evaporator.

5. The system of claim 4, further including a bleed valve in the second line between the check valve and the reheat coil, and a capillary tube between the bleed valve and a compressor suction line, the bleed valve metering a controlled amount of liquid refrigerant from the reheat coil into the compressor suction line without flooding a compressor, thereby preventing isolation of refrigerant liquid in the reheat coil when the valve in the first line selectively isolates the reheat coil from the compressor discharge line.

6. The system of claim 1 further including:

an economizer;

an outside temperature sensor in communication with the controller monitoring outside temperature;

an outside humidity sensor in communication with the controller monitoring return air humidity monitoring outside air humidity; and wherein the logic of the controller determines selective operation of the economizer in adding fresh outside air to return air as a function of outside temperature and outside humidity.

7. An air conditioning system, comprising:

a multi-circuit system having a plurality of independent cooling circuits, each of the independent cooling circuits having at least one compressor;

a hot gas reheat circuit integral with a first independent cooling circuit of the plurality of independent cooling circuits, comprising:

a reheat coil, the reheat coil being downstream of at least one evaporator of a plurality of evaporators in the multi-circuit system;

a first line placing the reheat coil in communication with a compressor discharge line of the first independent cooling circuit of the plurality of independent cooling circuits, the first line providing hot compressed refrigerant gas to the reheat coil; and a second line placing the reheat coil in communication with a liquid line, the liquid line supplying liquid refrigerant to an evaporator in the first independent cooling circuit integral with the hot gas reheat circuit, the second line providing condensed refrigerant from the reheat coil to the liquid line; and a controller including a logic program that matches the latent heat capacity of the system to the latent load of an interior space being conditioned and also matches the sensible heat capacity of the system to the sensible load of the interior space being conditioned by activation of a second independent cooling circuit of the plurality of independent cooling circuits and selective activation of the first independent cooling circuit integral with the hot gas reheat circuit.

8. The air conditioning system of claim 7, further comprising:

a return air temperature sensor in communication with the controller monitoring return air temperature;

a return air humidity sensor in communication with the controller monitoring return air humidity;

a supply air temperature sensor in communication with the controller monitoring supply air temperature;

a supply air dewpoint setpoint;

a supply air temperature setpoint;

wherein the controller adjusts a supply air dewpoint setpoint in response to a signal from the return air humidity sensor;

wherein the controller adjusts a supply air temperature setpoint in response to a signal indicative of a temperature from at least one of the return air temperature sensor and the supply air temperature sensor; and wherein the controller modulates operation of one of the plurality of independent cooling circuits and modulates operation of the hot gas reheat circuit integral with the first independent cooling circuit in response to the supply air dewpoint setpoint and the supply air temperature setpoint.

9. The system of claim 8, wherein the logic program of the controller determines a number of independent cooling circuits to activate of the plurality of independent cooling circuits and the number of compressors in each of the activated independent cooling circuits to activate in response to at least one of the signal from the return air temperature sensor indicative of return air temperature, the signal from the return air humidity sensor indicative of return air humidity, the supply air dewpoint setpoint, and the supply air temperature setpoint.

10. The system of claim 7, wherein the hot gas reheat circuit further comprises:

a valve in the first line selectively isolating the reheat coil from the compressor discharge line; and a check valve in the second line, the check valve positioned preventing the back flow of liquid refrigerant into the reheat coil from the liquid line to the evaporator.

11. The system of claim 10, further comprising a bleed valve in the second line between the check valve and the reheat coil, and a capillary tube between the bleed valve and a compressor suction line, the bleed valve metering a controlled amount of liquid refrigerant from the reheat coil into the compressor suction line without flooding a compressor, thereby preventing isolation of refrigerant liquid in the reheat coil when the valve in the first line selectively isolates the reheat coil from the compressor discharge line.

12. The system of claim 8, further comprising:

an economizer;

an outside temperature sensor in communication with the controller monitoring outside temperature;

an outside humidity sensor in communication with the controller monitoring return air humidity monitoring outside air humidity; and wherein the logic of the controller determines selective operation of the economizer in adding fresh outside air to return air as a function of outside temperature and outside humidity.

* * * * *